United States Patent [19]

Frantz

[11] Patent Number: 4,477,130

[45] Date of Patent: Oct. 16, 1984

[54] SECURITY CABINET FOR STORAGE OF VALUABLES

[75] Inventor: James S. Frantz, Roanoke, Va.

[73] Assignee: Tread Corporation, Roanoke, Va.

[21] Appl. No.: 465,555

[22] Filed: Feb. 10, 1983

[51] Int. Cl.[3] ..... E05B 65/06

[52] U.S. Cl. ..... 312/219; 76/388; 70/84; 292/29; 292/118; 312/138 R; 312/216; 312/222

[58] Field of Search ..... 312/215, 216, 219, 222, 312/138, 221, 107.5; 70/78, 81, 84; 49/394; 16/388; 292/118, DIG. 39, 100, 126, 300, 29

[56] References Cited

U.S. PATENT DOCUMENTS

| | | | |
|---|---|---|---|
| 998,871 | 7/1911 | Churchill | 70/81 |
| 1,511,725 | 10/1924 | Hart | 312/219 X |
| 1,515,611 | 11/1924 | O'Connor | 70/81 |
| 1,716,169 | 6/1929 | Hart | 70/81 |
| 1,791,134 | 2/1931 | Kaser | 312/222 |
| 2,163,752 | 6/1939 | Fohn | 70/81 |
| 2,717,064 | 9/1955 | Hock | 49/394 |
| 3,142,522 | 7/1964 | Hall et al. | 312/219 X |
| 3,297,376 | 1/1967 | Barstow | 312/219 |
| 3,511,549 | 5/1970 | Macaluso | 312/219 |
| 4,099,808 | 7/1978 | Oakley et al. | 312/138 R |

FOREIGN PATENT DOCUMENTS

| | | | |
|---|---|---|---|
| 222292 | 7/1962 | Austria | 312/219 |
| 2004855 | 9/1971 | Fed. Rep. of Germany | 49/394 |
| 2270425 | 12/1975 | France | 16/388 |

*Primary Examiner*—William E. Lyddane
*Assistant Examiner*—Thomas A. Rendos
*Attorney, Agent, or Firm*—Bell, Seltzer, Park & Gibson

[57] ABSTRACT

A security cabinet for protecting one's valuables having a key actuatable locking means provided with an elongate locking bar for lockingly engaging with a door flange provided on the inner side of the door. Additional locking means are provided along the hinge side of the door in the form of an additional key actuatable locking bar or a series of internal locking pins carried by the door and cooperating with cutouts provided in the surrounding door-jamb or frame.

6 Claims, 18 Drawing Figures

SECURITY CABINET FOR STORAGE OF VALUABLES

In recent years it is become increasingly commonplace for one to see steel security cabinets or chests in the home for containing the valuables of the household when such valuables are not being used. This arrangement provides a greater convenience for the homeowner as opposed to storing such valuables in the lockbox of a bank, for example.

With the foregoing in mind, it is the primary object of this invention to provide a cabinet of metal construction and wherein very simple lock means are provided for making it difficult for one not authorized to open the door of the cabinet or to jimmy the cabinet to attempt to gain access thereto. To this end, the locking means provided for the cabinet is key actuated and of elongate construction to engage a substantial length of the door along an inner flange on the inside of the door. The locking means is constructed so that the operable parts are hidden from view and thus not accessible for being tampered with. Further, the locking means by being of substantial length extending along the door serves to discourage one attempting to jimmy the door into open position.

A further feature of this invention is to provide additional locking means along the hinge side of the door which hinges may be exteriorly mounted and yet prevent access to the cabinet by removal of the hinges. This is accomplished by providing locking pins hidden from view along the hinge side of the door and carried by the inside of the door and cooperating with holes provided in surrounding adjacent areas of the cabinet. This effects an interlock along the hinge side of the door and thus prevents opening of the door even though the hinges might be removed.

A still further feature of this invention is to provide a key actuated locking means provided along opposite sides of the door wherein the door is of the type with external hinges. This arrangement provides further difficulty to one attempting to unauthorizingly open the door of the cabinet.

Other objects and features of the invention will appear in the following description when considered in connection with the accompanying drawings forming a part of this specification.

Referring now to the drawings.

Figure 12:
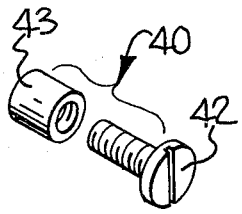
Figure 11:
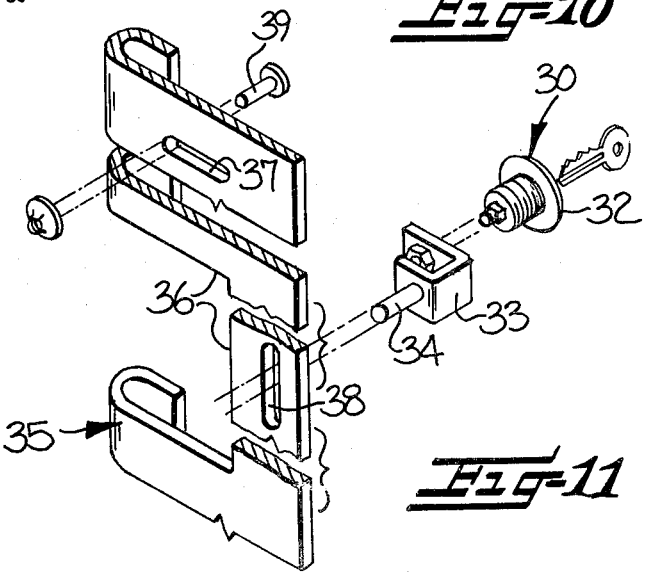
Figure 13:
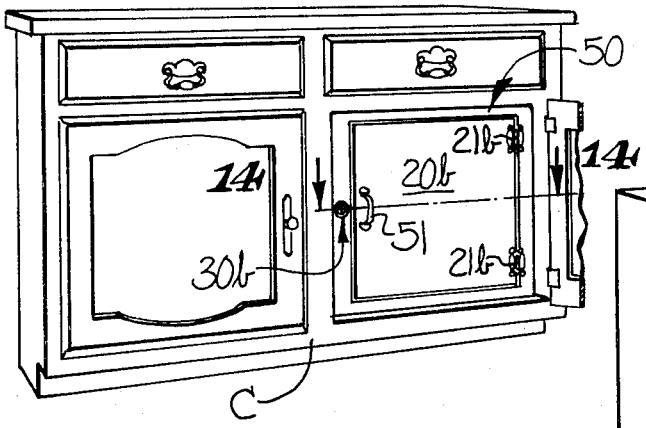
Figure 13A:
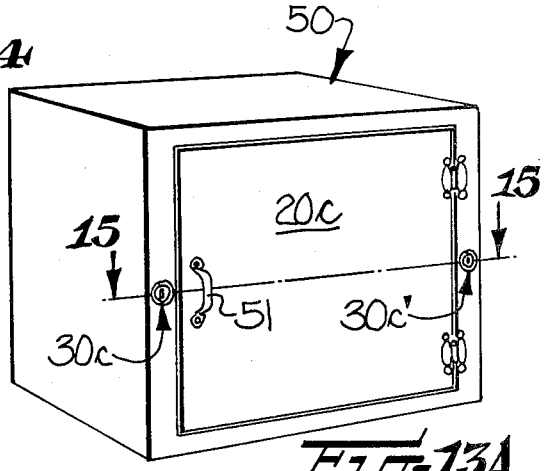
Figure 14:
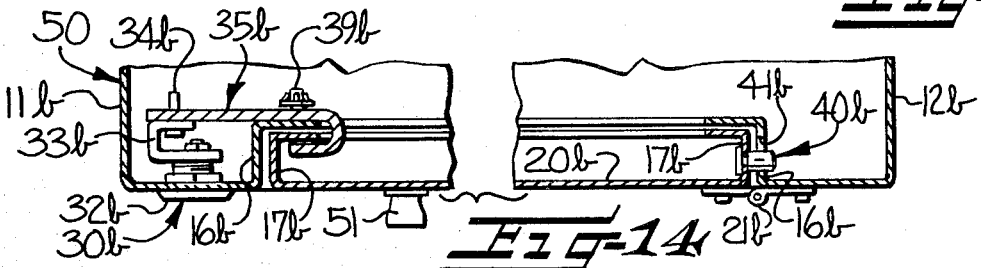
Figure 15:
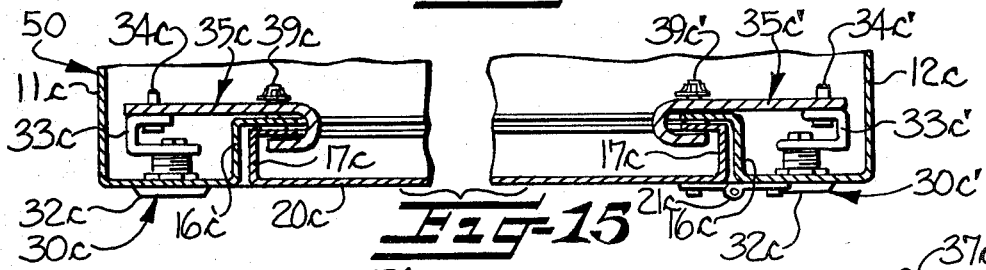
Figure 16:
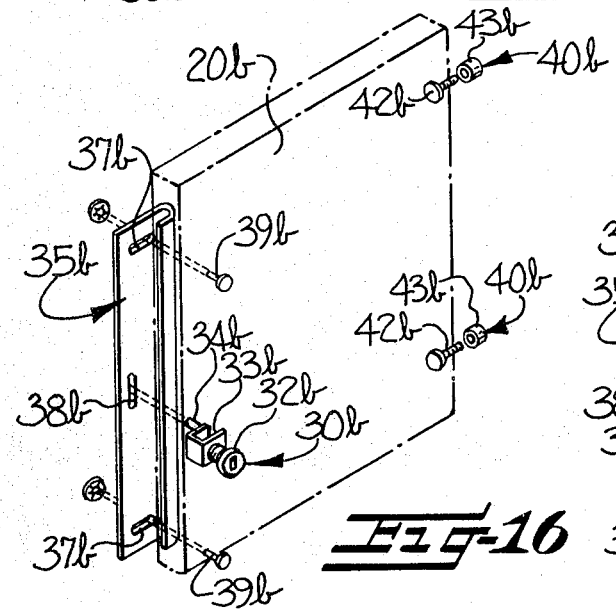
Figure 17:
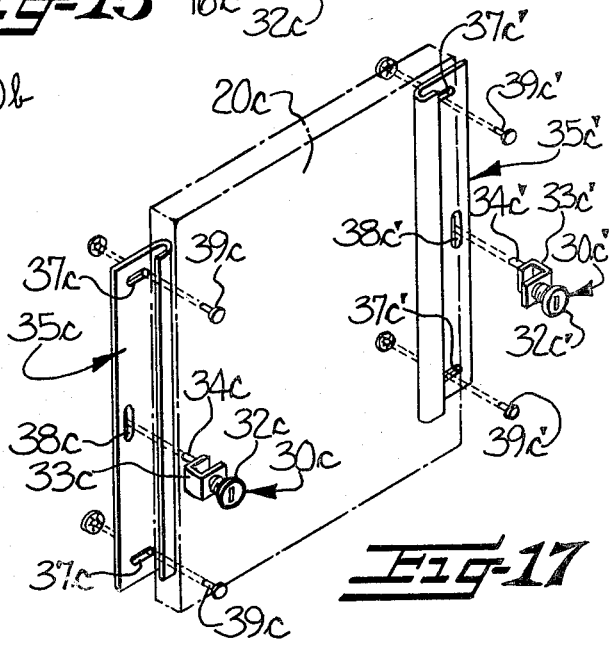

FIG. 11 a fragmentary exploded detail view with parts broken away of the key actuatable locking bar mechanism;

FIG. 12 is a fragmentary perspective view of the construction of the locking pins provided along the hinge side of the door as in the first form of the invention;

FIGS. 13 and **13*a*** views illustrating two additional forms of the invention wherein the security cabinet is of smaller construction and is adapted to be positioned underneath a countertop within a counter cabinet therebelow;

FIG. 14 is an enlarged horizontal sectional view taken substantially along line 14—14 of FIG. 13 and showing a locking arrangement for the security cabinet similar to those shown in FIGS. 1–7 of the first form of the invention;

FIG. 15 is another horizontal sectional view taken substantially along line 15—15 of FIG. **13*a* and illustrating key actuatable locking means provided along both sides of the cabinet door in a similar manner as in the second form of the invention illustrated in FIGS. 8–11**;

FIG. 16 is a schematic view illustrating the type of locking arrangement provided in the cabinet embodiment of FIG. 14; and FIG. 17 is another schematic view illustrating the locking arrangement provided in a cabinet of the embodiment of FIG. 15.

Referring now particularly to FIGS. 1–7 wherein the first form of the invention is illustrated, reference numeral 10 broadly indicates a metal security chest of the upright type having opposing pairs of sidewalls 11, 12, a back or rear wall 13 and top and bottom walls 14 and 15, respectively. The front of the cabinet is provided with a doorjamb or frame 16 defining an opening for a door 20 which is carried by hinges 21 exteriorly mounted on the doorjamb 16. Carried by the door 20 is a conventional hand engageable door handle 8 having a latching assembly 9 (FIG. 3) for maintaining the door in closed latched position. Also formed as part of the door 20 are opposed inner flanges 18 and 19, which extend longitudinally of the door and parallel to the inner face thereof with door flange 18 extending toward the hinged side of the door and door flange 19 extending away from the hinged side of the door.

Carried by the doorjamb 16 is a key actuatable locking mechanism broadly indicated by reference numeral 30 and which includes a key receiving component 32 exposed on the face of the doorjamb 16 adjacent the door handle 8. The key receiving component 32 has fixed thereto a thrower member 33 of substantially U-shaped construction and which in turn has a fixed pin 34 extending therefrom. It should be noted that the axis of pin 33 is offset or eccentric of the axis of the key receiving component 32. Comparing FIGS. 4 and 5 wherein the door is shown in locked and opened position respectively, it will be seen that upon the thrower member 33 moving from the position shown in FIG. 4 wherein the door is locked, to that shown in FIG. 5 where the door is open, the movement of the thrower member 33 causes the pin 34 to move a channel locking member or bar, broadly indicated at 35, inwardly from the locked position of FIG. 4 to that of the unlocked position of FIG. 5. Referring now more particularly to FIG. 11 wherein the details of the channel locking member 35 are shown in exploded condition, it will be noted that upon the pin 34 moving in the manner as thus described, a movement is imparted to the channel locking member 35. The channel locking member 35 is of elongate construction, and substantially U-shaped in cross section. A cutout 36 is provided intermediate the channel locking member 35 for accommodation of the door handle latching member 9.

Since the pin 34 attached to the thrower member 33 cannot impart a straightforward thrust to the channel locking bar member 35 without accommodation of upward movement of such pin during its stroke of movement, a vertical slot 38 is provided in the channel locking bar 35 for accommodating this type of movement of the pin 34. To further aid the channel locking bar 35 in its forward and backward sliding movement with reference to moving from the locked to the unlocked position and vice versa, a plurality of horizontal slots 37 are provided, namely, a pair of upper slots 37 and a pair of lower slots 37 (FIG. 3) positioned on opposite sides of the aforementioned vertical slot 38 through which the thrower pin 34 extends. Pins 39 which are carried by the doorjamb 16 loosely extend through horizontal slots 37 on the channel locking bar and thus serve for mountingly carrying the weight of the channel bar 35 at all times.

Figure 1:
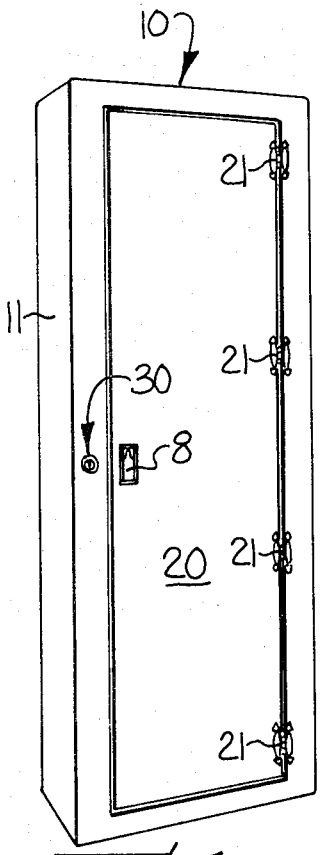
FIG. 1 is a perspective view of a cabinet of the type incorporating this invention and wherein decorative door hinges are shown exposed for adding aesthetic appeal thereto.
Figure 2:
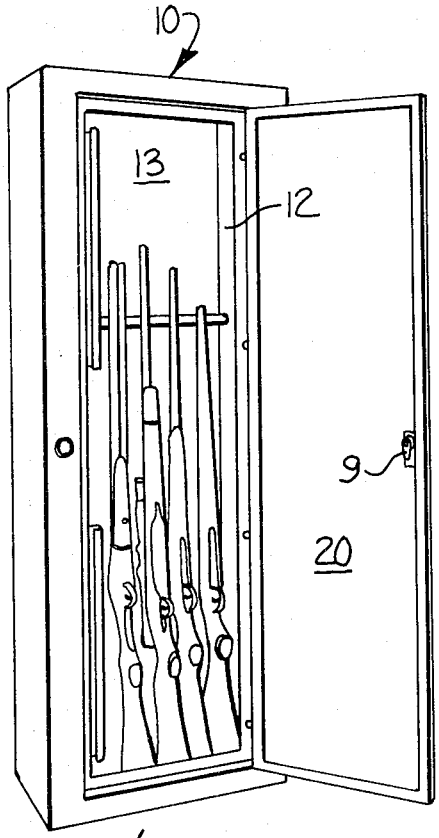
FIG. 2 is a view of the cabinet of FIG. 1 in unlocked position with the door opened.
Figure 3:
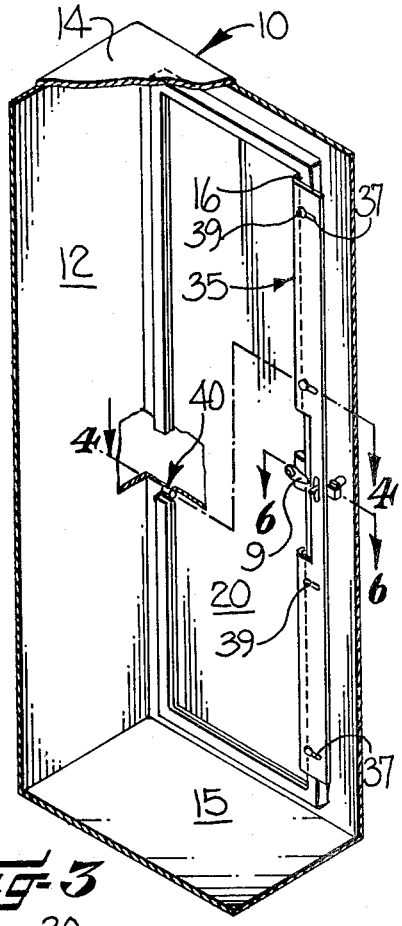
FIG. 3 is a longitudinal sectional view with parts broken away from within the cabinet of FIG. 1 at the inner side of the door in closed locked position.
Figure 4:
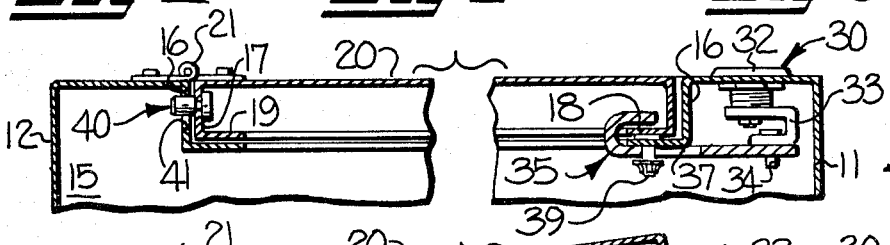
FIG. 4 is an enlarged horizontal sectional view taken substantially along line 4—4 of FIG. 3 with parts broken away and showing the door in closed, locked position.
Figure 5:
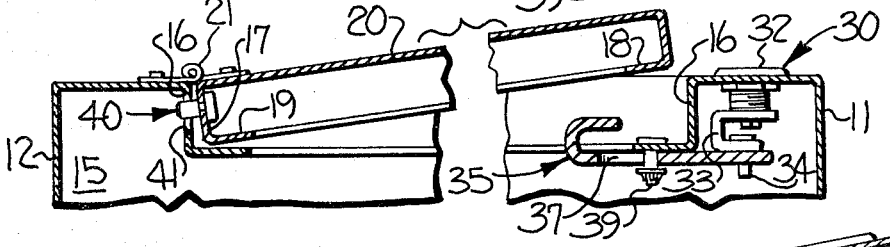
FIG. 5 is another enlarged horizontal sectional view similar to FIG. 4, but showing the door in opened, unlocked condition.
Figure 6:
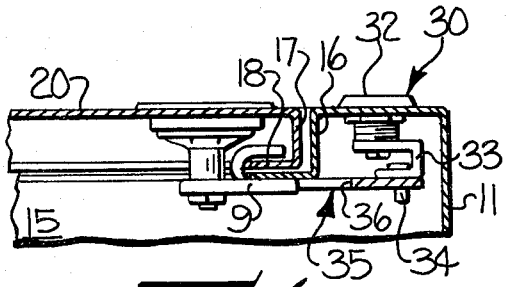
FIG. 6 is an enlarged fragmentary horizontal sectional view taken substantially along line 6—6 of FIG. 3 and showing the door in locked position.
Figure 7:
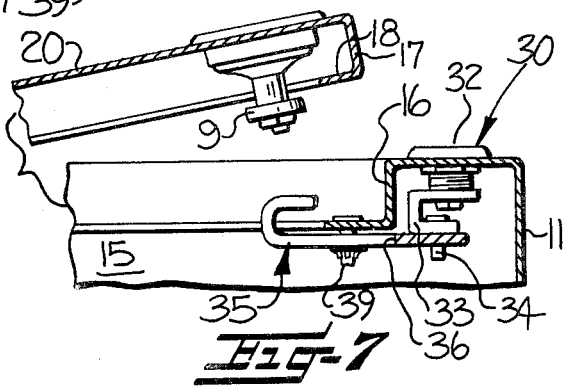
FIG. 7 is a view similar to FIG. 6, but showing the door in opened and unlocked position.

Referring now more particularly to FIG. 4, and comparing the same with that of FIG. 5, it will be noted that the U-shaped channel locking member 35 straddlingly receives the door flange 18 and thus serves to provide an obstruction if one attempts to open the door. It will further be appreciated from looking at FIG. 3 that the overall length of the channel locking member 35 is substantially the full length of the door except for cutaway portion 36 in the medial portion thereof for accommodating the door handle 8 and latch assembly 9. Thus it will be understood that substantially the entire length of the leading edge of the door is lockingly engaged by the channel locking bar 35 when the door is in locked position.

To further aid in maintaining the door in locked position and to prevent any jimmying of the door, locking means are provided alongside the opposite side of the door along the hinges 21. As noted earlier, the hinges 21 are illustrated as being of the decorative type for adding aesthetic appeal to the security cabinet. To prevent someone from opening the door by knocking the hinges loose therefrom, additional locking means are provided. This additional locking means, as illustrated in the first form of the invention of FIGS. 1–7, takes the form of a plurality of locking pins 40 carried by a perpendicular flange portion 17 of the door 20, and which pins 40 are shown as being four in number and substantially uniformly spaced apart from each other. For effecting an interlock with the pins 40, openings 41 are provided in the adjacent doorjamb 16 for accommodating reception of the pins 40 therein.

Referring now to FIG. 12 wherein the details of the locking pins 40 are illustrated, it will be noted that locking pins 40 each take the form of a threaded screw 42 having an internally threaded collar 43 cooperating therewith. As will be readily understood from viewing FIGS. 4 and 5, the threaded screw 42 is positioned through a small hole carried by the door flange 17 and once positioned through the hole, the threaded collar 43 is positioned thereon thus serving for clampingly mounting the pins on the door flange 17.

Figure 8:
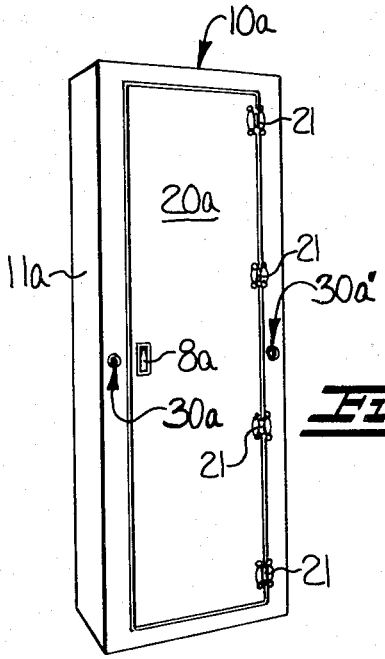
FIG. 8 is a perspective view of a second form of the invention wherein key actuatable locking means are provided along both sides of the door, instead of only one side as in the prior embodiment.
Figure 9:
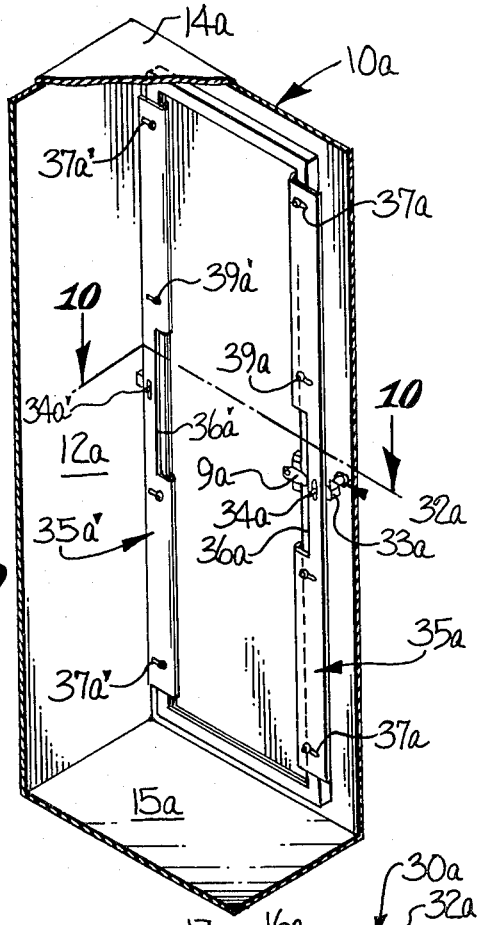
FIG. 9 is an enlarged longitudinal sectional view with parts broken away and looking from within the cabinet of FIG. 8 at the inner side of the door in closed, locked position.
Figure 10:
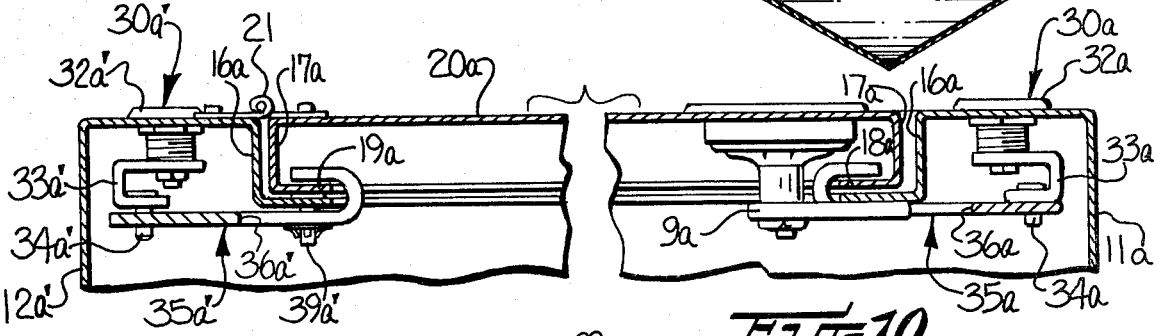
FIG. 10 is a horizontal sectional view on enlarged scale taken along line 10—10 of FIG. 9 with parts broken away.

Referring now to the second form of the invention, as illustrated in FIGS. 8–10, this form of the invention uses the same reference numerals for the same parts as in the first form of the invention with the suffix "a" added thereto. It will be understood that this form of the invention basically differs over the first form in that an additional channel bar locking device is provided on the hinge side of the door instead of the locking pins 40 of the first form of the invention. Accordingly, this additional locking bar device will bear the same reference numerals for the components thereof as in the first form with the prime notation added thereto along with the "a" suffix. As illustrated a separate key receiving component **30*a*' (FIG. 8) is provided on door jamb 16*a*** for operating the locking means in the desired manner from locked to unlocked condition. No purpose is seen in going through the details of this additional locking device in view of all the components thereof being substantially identical to those already described with reference to the first form of the invention.

Referring now to FIGS. 13, 14 and 16, it will be noted that this form of the invention corresponds almost identically to the first form of the invention and has the various like parts with the same reference numeral with the suffix "b" added thereto. The only difference in this form is in that a cabinet 50 is of smaller construction so as to be accommodated within a cabinet C underneath a countertop such as one finds within the home of many households. Since the type of cabinet 50 illustrated herein is provided with a pull handle 51 it will be noted that the locking bar **35*b*** is in the form of a continuous channel locking member instead of the same being interrupted at medial portions as in the first form of the invention.

Referring now to the last form of the invention as illustrated in FIGS. **13*a*, 15 and 17, this form of the invention corresponds very closely with the second form of the invention as illustrated in FIGS. 8–10 and has all like parts bearing the same reference numeral with the suffix "c" added thereto. This form differs thereover by the cabinet 50 being of smaller construction and the cabinet being provided with a pull handle 51 instead of a handle with an associated latching mechanism as in the second embodiment. Accordingly, the channel members 35*c*, 35*c*' which are provided for engaging with flanges on opposite sides of the door 20*c*** are shown as being uninterrupted channel members to engage substantially the entire height of the door.

It will thus be seen that a very simple locking bar arrangement is provided in conjunction with a metal cabinet for enhancing the security of contents positioned within such cabinet.

In the drawings and specification, there have been set forth embodiments of the invention, and although specific terms are employed, they are used in a generic and descriptive sense only and not for purposes of limitation.

That which is claimed is:

1. In a cabinet of metal construction and adapted for being used to protect one's valuables, said cabinet having a hinged door with a flange positioned along the inner side of the door and extending generally parallel to the face of the door and toward the hinged side of the door, the combination therewith of locking means carried by the cabinet on the side opposite from the hinged side of the door and cooperating with said door flange to maintain the cabinet door in locked closed position, said locking means comprising door flange obstructing means carried on the inside of the cabinet adjacent the door flange for contacting the outermost surface of said door flange so as to prevent outward movement of the door to the open position, and means operably connected to said door flange obstructing means for moving the same to the locked and unlocked positions with respect to the door flange.

2. In a cabinet of metal construction and adapted for being used to protect one's valuables, said cabinet having a hinged door with a flange positioned along the inner side of the door and extending generally parallel to the face of the door and toward the hinged side of the door, the combination therewith of locking means carried by the cabinet on the side opposite from the hinged side of the door and cooperating with said door flange to maintain the cabinet door in locked closed position, said locking means comprising a locking bar channel carried on the inside of the cabinet adjacent the door flange, said locking bar channel defining an opening facing away from the hinged side of the door for receiving said door flange therein when in locked position, and means operably connected to said locking bar channel for moving the locking bar channel to the locked and unlocked position with respect to the door flange.

3. In a cabinet of metal construction and adapted for being used to protect one's valuables, said cabinet having a hinged door with a flange positioned along the inner side of the door and extending generally parallel to the face of the door and toward the hinged side of the door, the combination therewith of locking means carried by the cabinet on the side opposite from the hinged side of the door and cooperating with said door flange to maintain the cabinet door in locked closed position, said locking means comprising a locking bar channel carried on the inside of the cabinet adjacent the door flange, said locking bar channel having a portion substantially U-shaped in cross section and defining an opening facing away from the hinged side of the door for receiving said door flange therein when in locked position, and key actuatable means operably connected to said locking bar channel for moving the locking bar channel to the locked and unlocked positions with respect to the door flange.

4. In a cabinet of metal construction and adapted for being used to protect one's valuables, said cabinet having a door with exposed hinges for the door extending along one side thereof and with a flange positioned along the inner side of the door and extending generally parallel to the face of the door and toward the hinged side of the door, the combination therewith of locking means carried by the cabinet on the side opposite from said hinges and cooperating with said door flange to maintain the cabinet door in locked closed position, said locking means comprising door flange obstructing means carried on the inside of the cabinet adjacent said door flange for engaging the outermost surface of the door flange to prevent outward movement of the door, means operably connected to said door flange obstructing means for moving the same between the locked and unlocked positions with respect to the door flange, and means positioned inside said cabinet along the hinged side of the door and hidden from view, for effecting an interlock of the door with adjacent cabinet portions to prevent the opening of the door when in the locked position through removal of the hinges from the door.

5. A cabinet according to claim 4 including an additional door flange adjacent the hinged side of the door and positioned along the inner side of the door and extending generally parallel to the face of the door and away from the hinged side of the door and wherein said means along the hinged side of the door for effecting an interlock of the door with adjacent cabinet portions comprises a second door flange obstructing means, and means operably connected to said second door flange obstructing means for selectively moving the same between locked and unlocked positions with respect to said additional door flange.

6. A cabinet according to claim 4 including another door flange adjacent the hinged side of the door and positioned along the inner side of the door and extending perpendicular to the face of the door, a door frame, and wherein said means along the hinged side of the door for effecting an interlock of the door with adjacent cabinet portions comprises a plurality of pins carried by said another door flange, and openings in said door frame adapted to be penetrated by and cooperate with said pins.

* * * * *